US007480997B2

(12) United States Patent
Ping

(10) Patent No.: US 7,480,997 B2
(45) Date of Patent: Jan. 27, 2009

(54) FOLDABLE KNIFE

(75) Inventor: Qiu Jian Ping, Hangzhou (CN)

(73) Assignee: Great Neck Saw Manufacturers, Inc., Mineola, NY (US)

( * ) Notice: Subject to any disclaimer, the term of this patent is extended or adjusted under 35 U.S.C. 154(b) by 0 days.

(21) Appl. No.: 11/705,181

(22) Filed: Feb. 12, 2007

(65) Prior Publication Data

US 2007/0130777 A1 Jun. 14, 2007

Related U.S. Application Data

(63) Continuation of application No. 10/912,850, filed on Aug. 6, 2004, now abandoned.

(51) Int. Cl.
*B26B 1/04* (2006.01)

(52) U.S. Cl. ..... 30/161; 30/159

(58) Field of Classification Search ..... 30/155, 30/160, 161, 162, 159
See application file for complete search history.

(56) References Cited

U.S. PATENT DOCUMENTS

| | | | | |
|---|---|---|---|---|
| 97,154 | A | 11/1869 | Barnard | |
| 493,075 | A | 3/1893 | Evertz | |
| 515,045 | A | 2/1894 | Bultzingslowen | |
| 584,077 | A | 6/1897 | Jackson | |
| 596,096 | A | 12/1897 | Watts | |
| 988,068 | A | 3/1911 | Beardsley | |
| 1,362,142 | A | 12/1920 | Rohrer | |
| 1,444,324 | A | 2/1923 | Brooks | |
| 1,706,251 | A | 3/1929 | Perry | |
| 1,750,577 | A | 3/1930 | De Bracht | |
| 1,782,901 | A * | 11/1930 | Kassel | 30/156 |
| 2,134,973 | A | 11/1938 | Harwell | |
| 2,265,775 | A | 12/1941 | McNamara | |
| 2,284,128 | A | 5/1942 | Bush | |
| 2,523,575 | A | 9/1950 | Kassel | |
| 2,814,108 | A | 11/1957 | Bassett | |
| 2,914,850 | A | 12/1959 | Kuhnl | |
| 2,980,996 | A | 4/1961 | Beran | |
| 3,306,297 | A | 2/1967 | Woorhees | |
| 3,568,315 | A | 3/1971 | Smith | |
| 3,593,417 | A | 7/1971 | West | |
| 3,872,591 | A | 3/1975 | Quenot | |

(Continued)

FOREIGN PATENT DOCUMENTS

| | | |
|---|---|---|
| CN | 02-2-88379.7 | 12/2002 |

(Continued)

*Primary Examiner*—Boyer D. Ashley
*Assistant Examiner*—Laura M. Lee
(74) *Attorney, Agent, or Firm*—Joseph J. Previto

(57) ABSTRACT

A utility knife having a handle and a blade holder which is pivotally mounted on the handle for movement from an unfolded position to a folded position. The handle has a space adapted to receive the blade holder when the blade holder is in its folded position. A spring pressed lock plug is provided to move into and out of the space to hold the blade holder in the folded and unfolded positions. The blade holder includes a main wall and guard wall pivotally mounted on the main wall to pivot from an open position to a closed position overlying the main wall. The main wall being adapted to hold a blade so that a blade is interposed between the main wall and guard wall when the guard wall is in its closed position.

6 Claims, 6 Drawing Sheets

U.S. PATENT DOCUMENTS

| | | | |
|---|---|---|---|
| 4,017,969 | A | 4/1977 | Stnebraker |
| 4,040,181 | A | 8/1977 | Johnson |
| 4,261,104 | A | 4/1981 | Cusovitch |
| 4,347,665 | A | 9/1982 | Glesser |
| 4,442,600 | A | 4/1984 | Felix-Salichow |
| 4,570,341 | A | 2/1986 | Konneker |
| 4,604,805 | A | 8/1986 | Krieger |
| 4,665,615 | A | 5/1987 | Martinez |
| 4,669,188 | A | 6/1987 | Evrell |
| 4,719,700 | A | 1/1988 | Taylor, Jr. |
| 4,805,303 | A | 2/1989 | Gibbs |
| 4,811,486 | A | 3/1989 | Cunningham |
| 4,920,644 | A | 5/1990 | La Gattuta |
| 4,936,014 | A | 6/1990 | Shaanan et al. |
| 5,044,079 | A | 9/1991 | Gibbs |
| 5,095,624 | A | 3/1992 | Ennis |
| 5,125,157 | A | 6/1992 | Howard |
| 5,400,509 | A | 3/1995 | Collins |
| 5,511,310 | A | 4/1996 | Sessions |
| 5,769,094 | A | 6/1998 | Jenkins, Jr. |
| 5,815,927 | A | 10/1998 | Collins |
| 5,822,866 | A | 10/1998 | Pardue |
| 5,826,340 | A | 10/1998 | Hull |
| 5,966,816 | A | 10/1999 | Roberson |
| 5,979,059 | A | 11/1999 | Leatherman |
| 6,170,104 | B1 | 1/2001 | Seber |
| 6,170,158 | B1 | 1/2001 | Daily |
| 6,256,887 | B1 | 7/2001 | Osborne |
| 6,256,888 | B1 | 7/2001 | Shuen |
| 6,263,581 | B1 | 7/2001 | Forte |
| 6,354,007 | B1 | 3/2002 | Scarla |
| 6,370,778 | B1 | 4/2002 | Conable |
| 6,397,477 | B1 | 6/2002 | Collins |
| 6,446,341 | B1 | 9/2002 | Wang |
| 6,487,740 | B2 | 12/2002 | Seber |
| D474,669 | S | 5/2003 | Onion |
| 6,574,868 | B1 | 6/2003 | Overholt |
| 6,688,003 | B2 | 2/2004 | Scarla |
| 6,691,357 | B2 | 2/2004 | Rivera |
| D494,437 | S | 8/2004 | Scarla |
| D495,939 | S | 9/2004 | Ping |
| 6,845,561 | B2 | 1/2005 | Timson |
| D501,782 | S | 2/2005 | Ping |
| 6,915,577 | B2 | 7/2005 | Scarla |
| D510,250 | S | 10/2005 | Ping |
| 6,968,622 | B2 | 11/2005 | Ping |
| D516,403 | S | 3/2006 | Ping |
| D517,893 | S | 3/2006 | Ping |
| 7,007,392 | B2 | 3/2006 | Ping |
| D519,019 | S | 4/2006 | Ping |
| 7,040,022 | B2 | 5/2006 | Ping |
| D522,835 | S | 6/2006 | Ping |
| D526,877 | S | 8/2006 | Ping |
| D526,878 | S | 8/2006 | Ping |
| D528,894 | S | 9/2006 | Ping |
| D528,895 | S | 9/2006 | Ping |
| 7,134,207 | B2 | 11/2006 | Ping |
| 2002/0059730 | A1 | 5/2002 | Flavigny |
| 2004/0020057 | A1 | 2/2004 | Hughes |
| 2004/0045171 | A1 | 3/2004 | Moizis |
| 2004/0103541 | A1 | 6/2004 | Scarla |
| 2004/0158991 | A1 | 8/2004 | Freeman |
| 2005/0144788 | A1 | 7/2005 | Lake |
| 2005/0223562 | A1 | 10/2005 | Pardue et al. |

FOREIGN PATENT DOCUMENTS

| | | |
|---|---|---|
| CN | 200420008852.7 | 3/2004 |
| CN | 200420020589.3 | 3/2004 |
| CN | 200420020590.6 | 3/2004 |
| CN | 200420020591.0 | 3/2004 |
| CN | 200420008854.6 | 3/2006 |
| WO | WO90/08633 | 8/1990 |

* cited by examiner

FOLDABLE KNIFE

RELATED APPLICATION

This application is a continuation of U.S. patent application Ser. No. 10/912,850 filed Aug. 6, 2004 now abandoned.

This is an improvement of U.S. patent application Ser. No. 10/750,134 filed Dec. 31, 2003, the entire contents which are incorporated herein by reference.

BACKGROUND

The present invention relates to a foldable knife and more particularly to a foldable utility knife in which the blade may be folded into the handle when the knife is not in use.

Utility knives have been in use for a number of years. Some of these utility knives have blades that are mounted on a blade holder which is foldable within a handle when the knife is not in use. In addition, some of these utility knives have many movable parts which makes them difficult to use and expensive to manufacture. Moreover, other of these utility knives comprises complicated mechanisms for folding the blade holder into the handle.

OBJECTS

The present invention overcomes these problems and has for one its objects the provision of an improved utility knife in which the blade holder may be easily folded into the handle. handle.

Another object of the present invention is the provision of an improved utility knife in which the blade is held securely on the utility knife.

Another object of the present invention is the provision of an improved utility knife which is simple to use and inexpensive to manufacture and maintain.

Other and further objects of the invention will be obvious upon an understanding of the illustrative embodiment about to described, or will be indicated in the appended claims and various advantages not referred to herein will occur to one skilled in the art upon employment of the invention in practice.

DRAWINGS

A preferred embodiment of the invention has been chosen for purposes of illustration and description and is shown in the accompanying drawings forming a part of the specification, wherein.

DESCRIPTION

Figure 1:
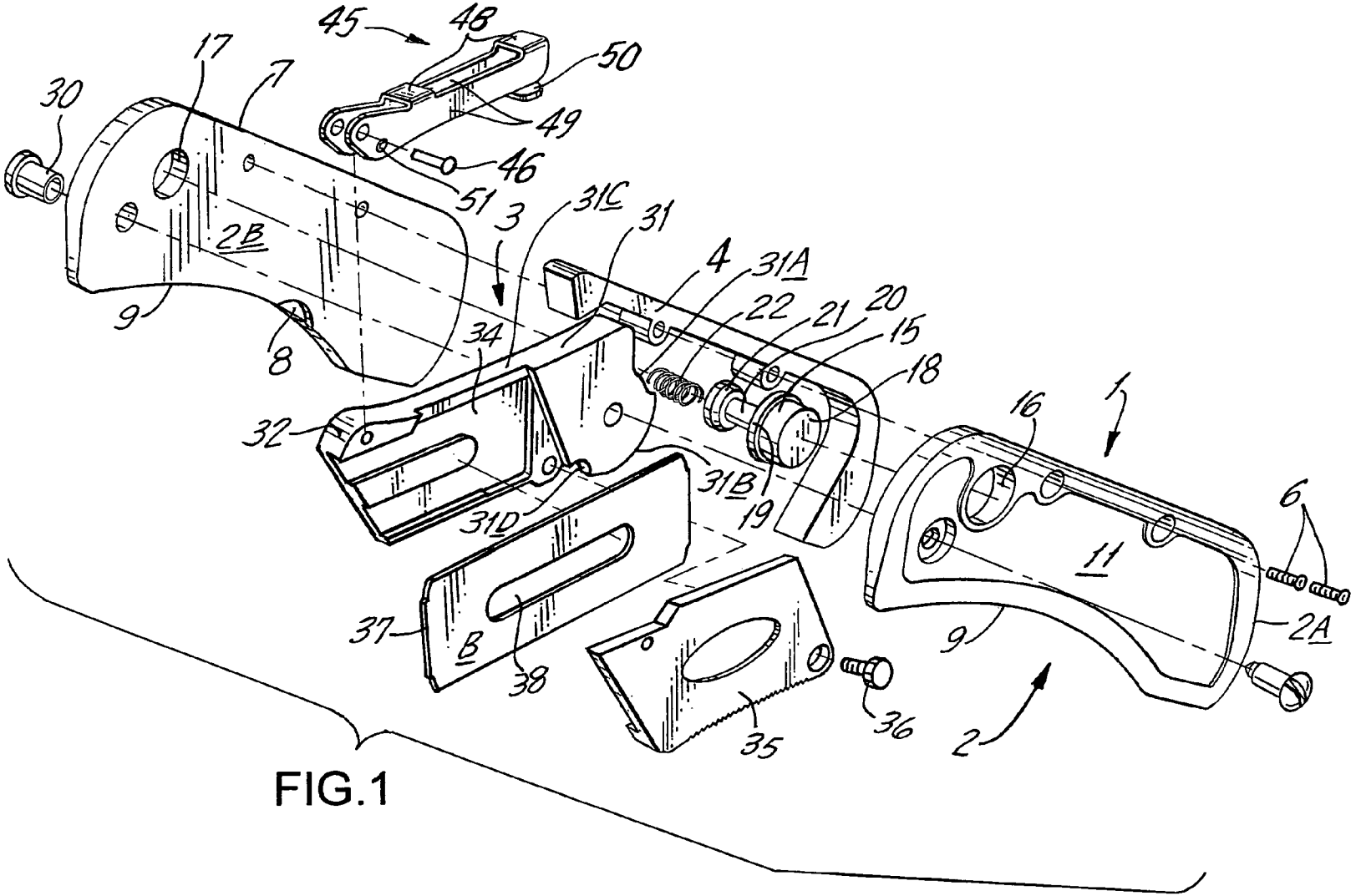
FIG. 1 is an exploded perspective view of a utility knife made in accordance with the present invention.
Figure 2:
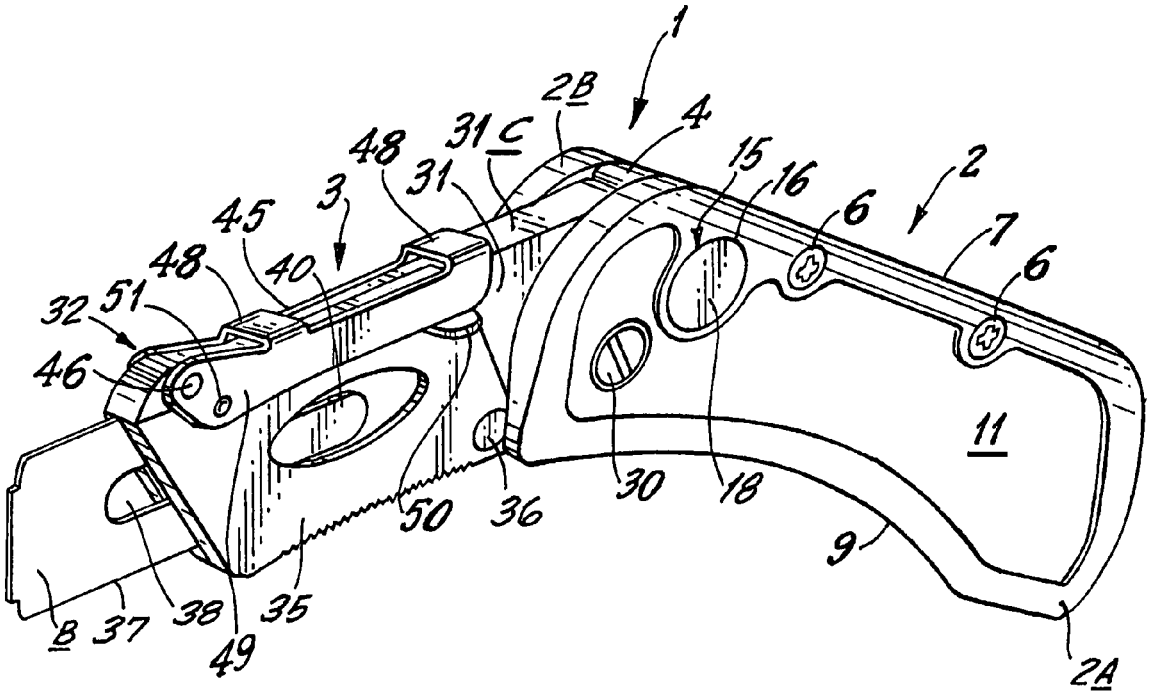
FIG. 2 is a perspective view of the utility knife showing the blade holder in an extended position.
Figure 3:
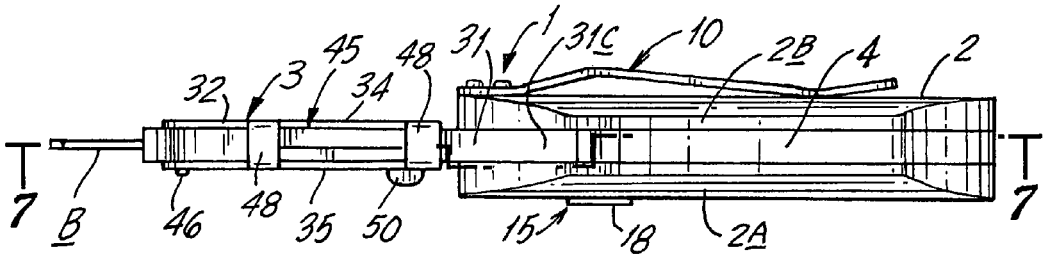
FIG. 3 is a top plan view thereof.

Referring to the drawings, the utility knife 1 of the present invention comprises a handle assembly 2 and a blade holder 3.

The handle 2 comprises a pair of handle halves 2A and 2B each having an outer side wall 11, an upper edge 7 and a lower edge 9. A spacer 4 is provided between the handle halves 2A and 2B to maintain the handle halves 2A and 2B separated and to create a space 5 between handle halves 2A and 2B. The spacer 4 and the handle halves 2A and 2B are held together by fasteners 6 which pass through the spacer 4 and the handle halves 2A and 2B in order to hold them together. The lower edge 9 of the handle halves 2A and 2B (i.e. the handle 2) has an internal notch 8 to receive a portion of the blade holder 3 when the blade holder 3 is folded into the handle 2. The lower edge 9 of the handle halves 2A and 2B (i.e. the handle 2) may be curved in order to permit the user's fingers to grip the handle 2. If desired, a clip 10 may be mounted on a side wall 11 of the handle halves 2A and/or 2B to permit the utility knife 1 to be fastened onto the user's belt or some other convenient place.

Figure 5:
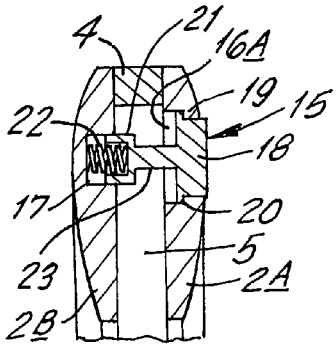
FIG. 5 is a sectional view taken along the line 5-5 of FIG. 4.
Figure 6:
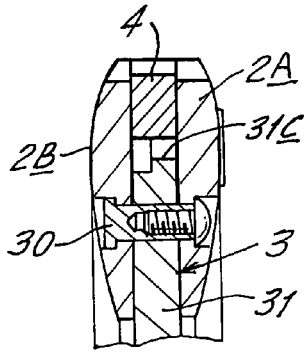
FIG. 6 is a sectional view taken along line 6-6 of FIG. 4.

Interposed between the handle halves at 2A and 2B there is provided a lock assembly 15 which extends from an opening 16 in handle half 2A and into notch 17 in handle half 2B. The lock assembly 15 comprises a push button 18 mounted in opening 16 and held in place by enlarged flange 19 abutting against the enlarged inner shoulder 20 of the opening 16 (FIG. 5). A lock knob 21 is mounted at the end of a shaft 23 which extends from the push button 18. The lock knob 21 is anchored in notch 17. The lock knob 21 is preferably hollow and has a spring 22 mounted therein which bears against the inner wall of opening 17 to bias the push button 18 toward the handle half 2A and away from the handle half 2B. The lock knob 21 length is equal to the depth of the notch 17. When the lock assembly 15 is in its normal position with the spring 22 biasing it against the handle half 2A the lock knob 21 extends into the space 5 between the halves 2A and 2B. When the push button 18 is pushed inwardly the lock knob 21 is moved completely into the opening 17 and is out of the space 5.

The blade holder 3 of the present invention comprises a rear end 31 and a front end 32 which are preferably integral with each other.

The rear end 31 of the blade holder 3 has rear edge 31A, bottom edge 31B and upper edge 31C. The blade holder 3 is pivotally mounted in the space 5 between handle halves 2A and 2B on a pivot pin 30.

The front end 32 of the blade holder 3 comprises a thin main wall 34 and a thin guard wall 35 pivotally mounted on the main wall 34 on pivot pin 36. The main wall 34 is adapted to hold a blade B which has a lower cutting edge 37 and an elongated opening 38 along its central longitudinal axis. The blade B is shown in the drawings as being generally rectangular in shape and can be used to cut carpets, if desired. However it will be understood that the blade B can be of a different shape and may be used for any purpose without departing from the invention. The main wall 34 has an elongated protrusion 40 extending therefrom along its central longitudinal axis which is adapted to enter the elongated opening 38 of the blade B to hold the blade B in place on the main wall 34. It will be seen that when the guard wall 35 is in its closed raised position it covers and holds the blade B in place but when it is in its open downward position, the blade B is exposed.

Figure 13:
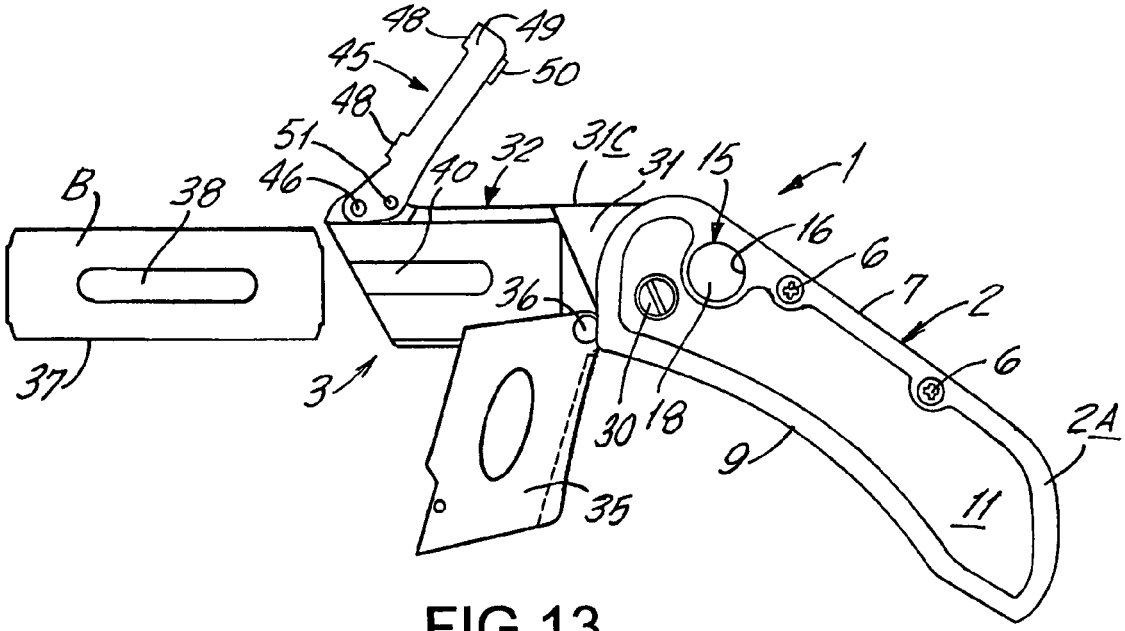
FIG. 13 is a plan view similar to FIG. 4 showing the manner of removing and replacing the blade.
Figure 14:
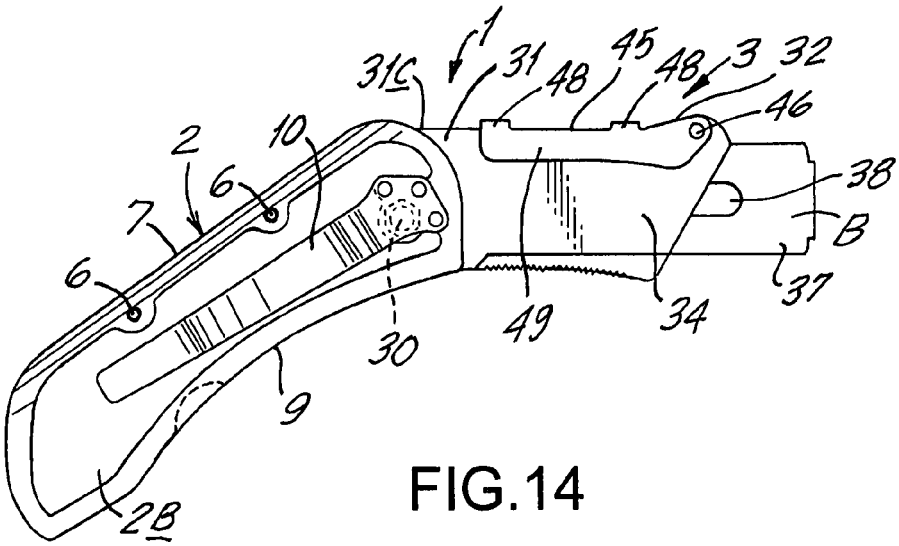
FIG. 14 is a plan view of the opposite side of the utility knife.

A blade lock assembly 45 is mounted along the upper edge 31C of the blade holder 30 and is pivotally mounted on the front end 32 of the blade holder 30 on pivot pin 46. The blade lock assembly 45 is in the form of a u-shaped clip having a segmented or interrupted top wall 48, a pair of side walls 49 depending from the top wall 48 and a side finger tab 50 extending outwardly therefrom. When the blade lock assembly or clip 45 is pivoted downwardly around pivot 46, its side walls 49 straddle the walls 34 and 35 of the blade holder 3 and its top wall 48 overlies the main and guard walls 34 and 35 as well as the blade B in order to lock the blade B in place. Inwardly extending pimples 51 may be provided in the side walls 49 to frictionally engage the main and guard walls 34-35 to hold the lock assembly 45 in place. When it is desired to remove and replace the blade B the clip 45 is pivoted upwardly by means of its finger tab 50 to release the walls 34-35 and the blade B. This permits the guard wall 35 to be pivoted away from the blade B (as shown in FIG. 13) in order to expose the blade B and permit the blade B to be removed and replaced.

Figure 4:
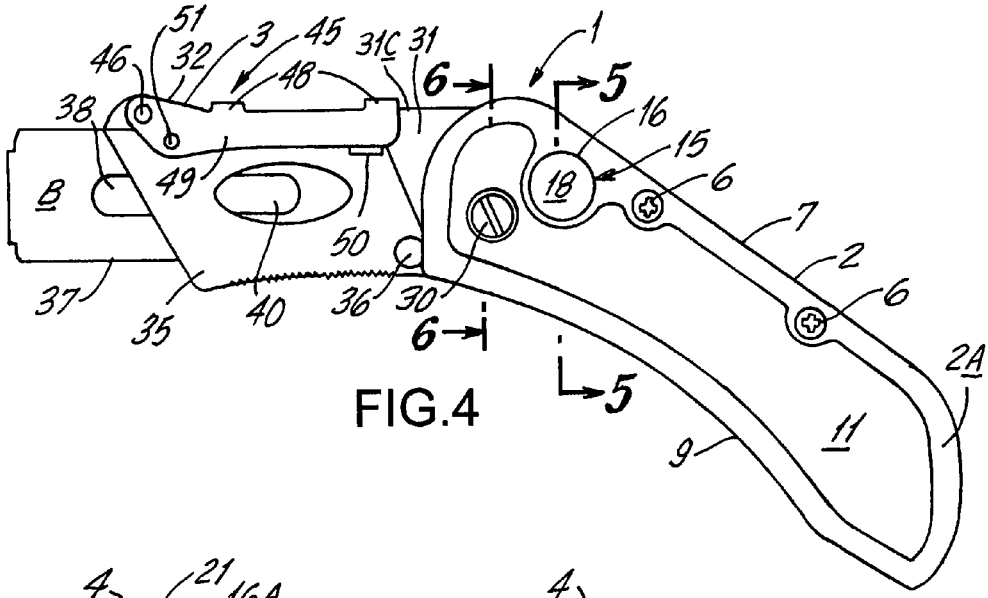
FIG. 4 is a side plan view thereof.
Figure 7:
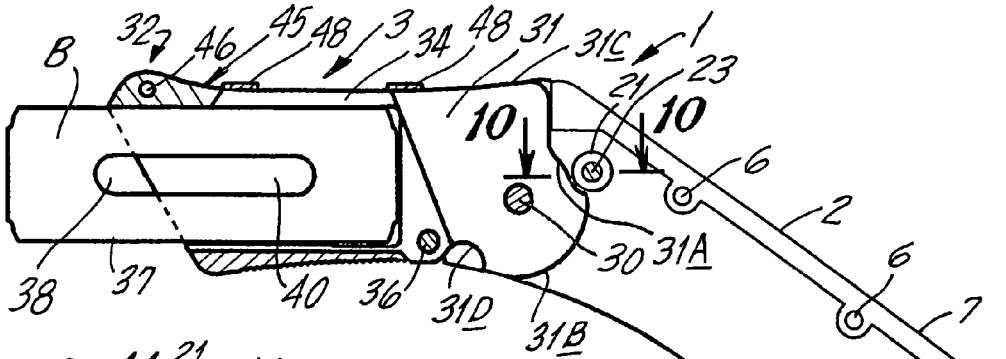
FIG. 7 is a sectional view taken along lines 7-7 of FIG. 3.

In operation, the utility knife 1 is placed in its operative unfolded position with the blade holder 3 unfolded and ready to be used (FIG. 4). The blade B is held on the main wall 34 by the protrusion 40 extending into opening 38 in the blade B. The lock knob 21 of the lock assembly 15 is in its outward position (because of the pressure of spring 22 thereon) and is positioned in the space 5 behind rear edge 31A of the blade holder 3 where it bears against the rear edge 31A of the blade holder 3 in order to hold the blade holder 3 in its unfolded position (FIG. 7). The push button 18 of the lock assembly 15 is in its outermost position and may protrude slightly beyond the opening 16 of the handle half 2A.

Figure 8:
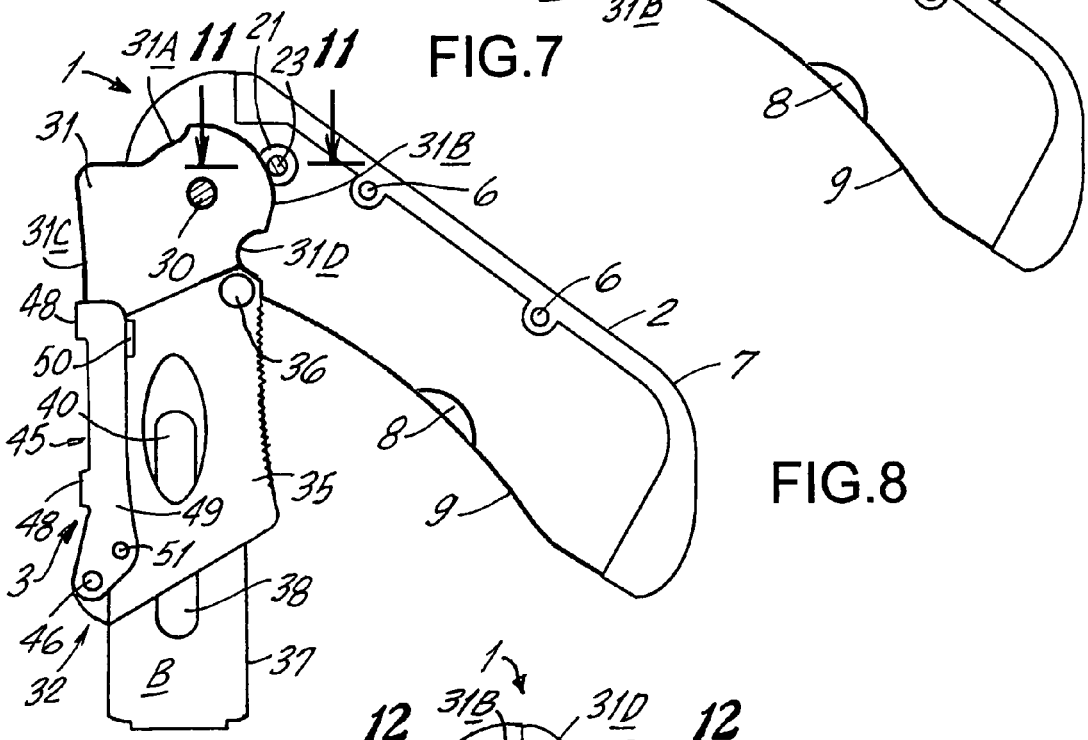
FIG. 8 is a sectional view similar to FIG. 7 showing the utility knife in a partially folded position, and with the blade holder shown in full line.
Figure 9:
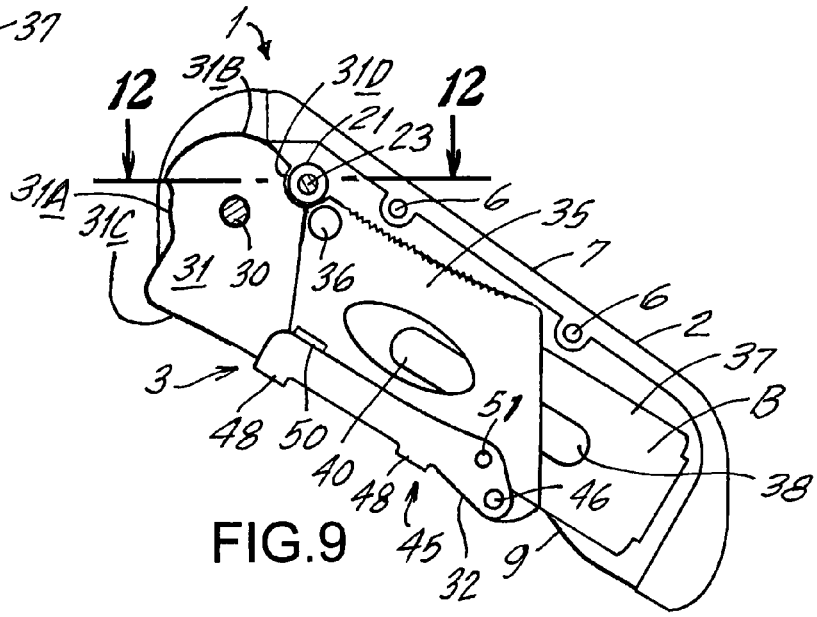
FIG. 9 is a sectional view similar to FIG. 8 showing the utility knife in a folded position.
Figure 10:
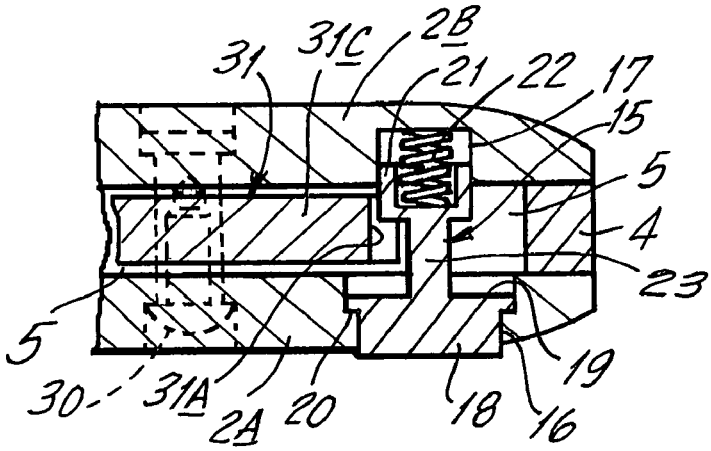
FIG. 10 is a sectional view taken along line 10-10 of FIG. 7.
Figure 11:
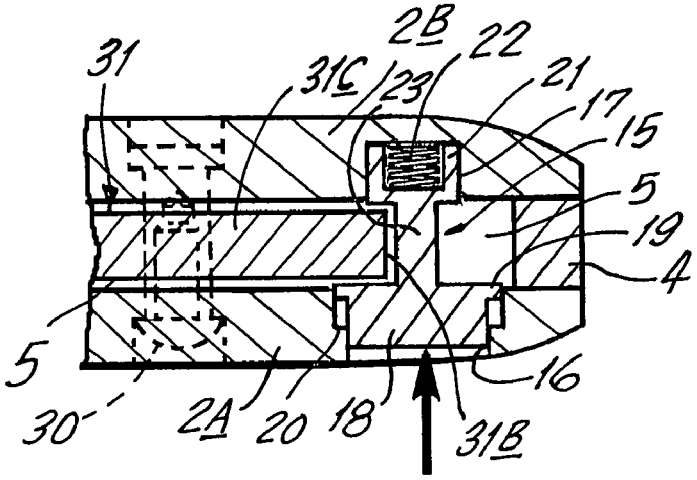
FIG. 11 is a sectional view taken along line 11-11 of FIG. 8.
Figure 12:
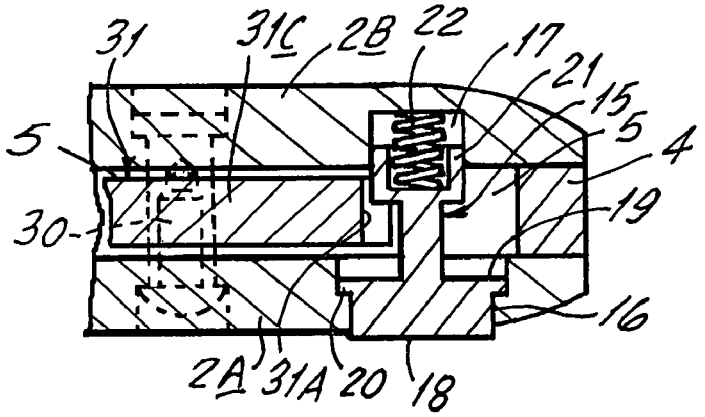
FIG. 12 is a sectional view taken along line 12-12 of FIG. 9.

When it is desired to place the utility knife 1 into its folded inoperative position, the push button 18 of the lock assembly 15 is pressed manually inwardly against the bias of the spring 22. This causes the lock knob 21 to move entirely into the notch 7, out of the space 5 and away from the rear edge 31A. The blade holder 3 is no longer held in its extended position by the lock back 21 bearing against rear edge 31A and is now free to pivot downwardly in one direction around the pivot pin 36 (FIG. 8) until the blade holder 3 completely enters the space 5 between the handle halves 2A and 2B (FIG. 9). When pressure on push button 18 is released, the spring 22 moves the push button 18 and the lock knob 21 back to its original position toward the handle half 2A by the tension of the spring 22. This causes the lock knob 21 to move into the space 5 and to position itself behind bottom edge 31B and into notch 31D in bottom edge 31B so as to bear against the bottom edge 31B of the blade holder 3 thereby holding and locking the blade holder 3 in its folded position.

When it is desired to use the blade B, the reverse procedure is followed and the blade holder 3 is pivoted upwardly in the opposite direction. The push button 18 of the lock assembly 15 is again depressed manually to move the lock knob 31A out of space 5 and away from its position behind button edge 31B and out of notch 31D so that the blade holder 3 can pivot in the opposite direction around pivot 30. Once this rotation begins the push button 18 may be released so that the lock knob 21 moves back into the space 5. The blade holder 3 is continued to be rotated in that direction until its rear edge 31A is again in front of the lock knob 21 of the lock assembly 15 in order to hold the blade holder 3 in its extended position.

When it is desired to replace a blade B, the blade holder 3 is placed in its unfolded position (as shown in FIG. 13) and the clip 45 is lifted around pivot 46 by means of finger tab 50 thereby the releasing of guard wall 35 and permitting it to be pivoted downwardly around pivot 36 to expose the blade B. The blade B can then be moved out of the blade holder 3 and a new blade B can be placed therein. The guard wall 35 is again pivoted upwardly back into position over the blade B and the clip 45 is lowered to lock the blade B and the walls 34 and 35 in place.

It will be seen that the present invention provides a utility knife in which the blade holder may be easily folded into a handle with the use of complicated mechanism and which is simple to use and inexpensive to manufacture and maintain.

As many and varied modifications of the subject matter of this invention will become apparent to those skilled in the art from the detailed description given hereinabove, it will be understood that the present invention is limited only as provided in the claims appended hereto.

The embodiments of the invention in which an exclusive property or privilege is claimed are defined as follows:

1. A foldable knife comprising a handle and a blade holder, said handle having opposed side walls, an upper edge and a lower edge, said blade holder having a mechanism for holding a blade therein, said blade holder being pivotally mounted on said handle for movement from an unfolded position to a folded position, said handle having a space adapted to receive at least a portion of said blade holder when the blade holder is in its folded position, said handle having a lock assembly mounted thereon, said lock assembly having a lock knob normally positioned in the said space in the handle and cooperating with said blade holder in its folded position, said lock knob being positioned and moveable substantially at a right angle to said side walls to lock the blade holder in said unfolded position and in said folded position, said blade holder having a main wall having an axis and a guard wall movably mounted on said main wall from an open position to a closed position overlying said main wall, said main wall having means to hold a blade thereon whereby a blade is interposed between said main wall and said guard wall, said blade holding means comprising an elongated blade supporting protrusion substantially parallel to said axis for supporting a blade, and top, bottom and rear ledges on said main wall to contain a blade between said walls, said blade holder has a rear edge and wherein said lock knob is positioned behind said rear edge when the blade holder is in its unfolded position to bear against said rear edge and hold the blade holder in its unfolded position, a spring associated with said lock assembly to bias the lock knob in said position behind said rear edge, whereby moving said lock assembly against the tension of the spring means will cause the lock knob to move out of the said space and away from behind said rear edge thereby permitting the blade holder to pivot relative to the handle from an unfolded position to a folded position, said handle comprises a pair of spaced handle halves, the lock assembly has a push button extending into one of said handle halves, said lock knob is mounted on a shaft extending from said push button and wherein said lock knob sits in a notch on the other of said handle halves, said lock knob is hollow and said spring means is positioned in said button, said blade holder comprises a rear end and a front end, said front end comprising said guard wall and said main wall, said rear end being pivotally mounted to said handle and having upper, rear and bottom edges, said guard wall is pivotally mounted to said main wall on a pivot adjacent the bottom edge of said rear end.

2. A foldable knife as set forth in claim 1 wherein a blade lock assembly is mounted for pivotal movement relative to said main and guard walls from an open position to a closed position overlying the main wall and the guard wall.

3. A foldable knife as set forth in claim 2, wherein said blade lock assembly is pivotally mounted on said front end adjacent to said upper edge.

4. A foldable knife as set forth in claim 3 wherein said blade lock assembly comprises a u-shaped clip having a top wall and a pair of side walls and wherein said side walls straddle said main wall and a said guard wall when a said clip is in its closed position.

5. A foldable knife as set forth in claim 4 wherein said clip has a side finger extending therefrom.

6. A foldable knife as set forth in claim 5, wherein an inwardly extending pimple is provided on the side walls of said lock assembly to frictionally hold the lock assembly in place.

* * * * *